United States Patent [19]

Broska

[11] 3,956,912

[45] May 18, 1976

[54] FILING CABINET LOCK HAVING PLATE TUMBLER-TYPE PLUG ASSEMBLY

[75] Inventor: John S. Broska, Chicago, Ill.

[73] Assignee: Chicago Lock Co., Chicago, Ill.

[22] Filed: Jan. 29, 1975

[21] Appl. No.: 544,884

[52] U.S. Cl. ..... 70/360; 70/364 R

[51] Int. Cl.[2] ..... E05B 29/04

[58] Field of Search ..... 70/78, 79, 80, 81, 82, 70/83, 360, 364 R, 369, 370, 372, 373, 416, 417, 431, 447, 448, 449

[56] References Cited

UNITED STATES PATENTS

| | | | |
|---|---|---|---|
| 1,575,092 | 3/1926 | Best | 70/373 |
| 1,645,006 | 10/1927 | Jacobi | 70/417 X |
| 3,782,139 | 1/1974 | Robner | 70/81 |

FOREIGN PATENTS OR APPLICATIONS

| | | | |
|---|---|---|---|
| 1,300,449 | 7/1969 | Germany | 70/370 |

*Primary Examiner*—Robert L. Wolfe
*Attorney, Agent, or Firm*—Norman H. Gerlach

[57] ABSTRACT

A filing cabinet lock including a generally elliptical barrel having a cylindrical longitudinal plug-receiving bore is provided with a key plug assembly of the spring-pressed plate tumbler type rotatable in the bore and adapted for cooperation with a single-bitted key. First and second slots are provided in the barrel along the bore, for reception of the tumbler ends projecting from the plug assembly when locked and during unlocking, respectively. The outer end of the first slot and a portion of the outer end of the second slot are covered by a plug head in the assembly, and the remaining portion of the outer end of the second slot is covered by a cover member mounted on the barrel, whereby access to the slots from outside of the barrel is prevented.

7 Claims, 7 Drawing Figures

FILING CABINET LOCK HAVING PLATE TUMBLER-TYPE PLUG ASSEMBLY

BACKGROUND OF THE INVENTION

This invention relates to a filing cabinet lock, more particularly, to a lock including a generally elliptical barrel having a cylindrical plug-receiving bore extending longitudinally from one end thereof, and a key plug assembly rotatable in the bore and adapted for cooperation with a single-bitted key.

Filing cabinet locks are generally standardized in their height and width dimensions and in the generally elliptical or elongated oval configuration of their barrel or cylinder. Lock standardization comports with standardization of cabinet construction. Accordingly, as a practical matter, improvements in filing cabinet lock construction are circumscribed by the limitations of the standard dimensions and configuration.

Heretofore, the filing cabinet locks employed have been of the radial split-pin tumbler type. Locks of this type include a rotatable key plug, and split-pin tumblers and tumbler springs. They require either an insert designed to receive portions of the tumblers, or comparable construction in the lock barrel. The parts and labor costs of the pin tumbler locks are relatively high, so that it would be desirable to reduce such costs and provide a more economical lock.

SUMMARY OF THE INVENTION

The invention provides in a filing cabinet lock including a barrel having a generally elliptical cross section and a cylindrical plug-receiving bore extending longitudinally from one end thereof, the improved combination with a key plug assembly of the spring-pressed plate tumbler type rotatable in the bore and adapted for cooperation with a single-bitted key, the plug assembly including a key plug having a cylindrical body received in the bore and an enlarged cylindrical head on the body, and a plurality of plate tumblers and tumbler springs mounted in the body, said tumblers being movable in the body between positions projecting alternately from opposite sides of the body when in locking interengagement with the barrel and during unlocking, and positions substantially within the confines of the body when unlocked, means forming first and second slots in the barrel and extending from the barrel end along the bore on opposite sides thereof, the slots receiving the tumbler ends projecting from opposite sides of the plug body, the plug head covering the outer end of the first slot and a portion of the outer end of the second slot, and a cover member mounted on the barrel and covering the remaining portion of the outer end of the second slot, whereby access to the slots from outside of the barrel is prevented.

In a preferred embodiment of the invention, the barrel is provided with a cover mounting slot extending longitudinally from the barrel end, and the structure includes a mounting arm extending inwardly from the cover member into the cover mounting slot. A further preferred embodiment includes a catch extending transversely from the cover member and behind the plug head, for retention of the cover member thereby.

The invention provides a simpler, more economical file cabinet lock. The plate or disc tumblers are more economical than the pin tumblers, and there is no need for an insert or other construction adapted to receive pins in the lock barrel. The barrel may be die cast, as before, while the face of the lock is closed, except for the keyway, when the parts of the locks are assembled. Assembly time and labor are reduced.

BRIEF DESCRIPTION OF THE DRAWINGS

The attached drawings illustrate a preferred embodiment of the invention, without limitation thereto. In the drawings, like elements are identified by like reference symbols in each of the views, and.

DESCRIPTION OF THE PREFERRED EMBODIMENT

Figures 1, 2, 3:
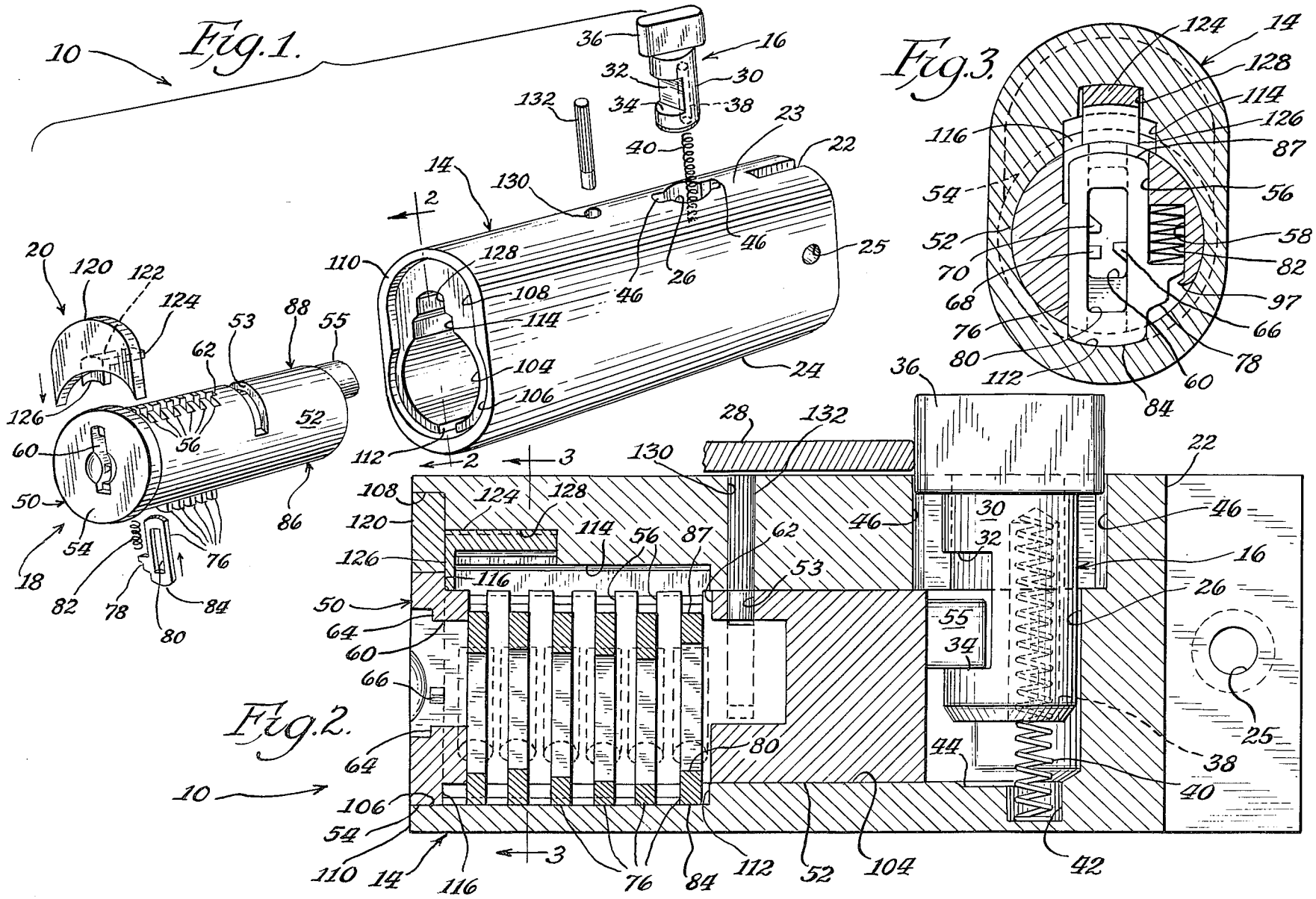
FIG. 1 is an exploded perspective view from the front or outer end and one side of a filing cabinet lock according to the invention.
FIG. 2 is an enlarged longitudinal sectional view of the assembled lock, taken substantially on line 2—2 of FIG. 1, and of a file cabinet member shown fragmentarily adjacent to the lock.
FIG. 3 is a cross sectional view of the lock, taken substantially on line 3—3 of FIG. 2.
Figures 4, 5, 6, 7:
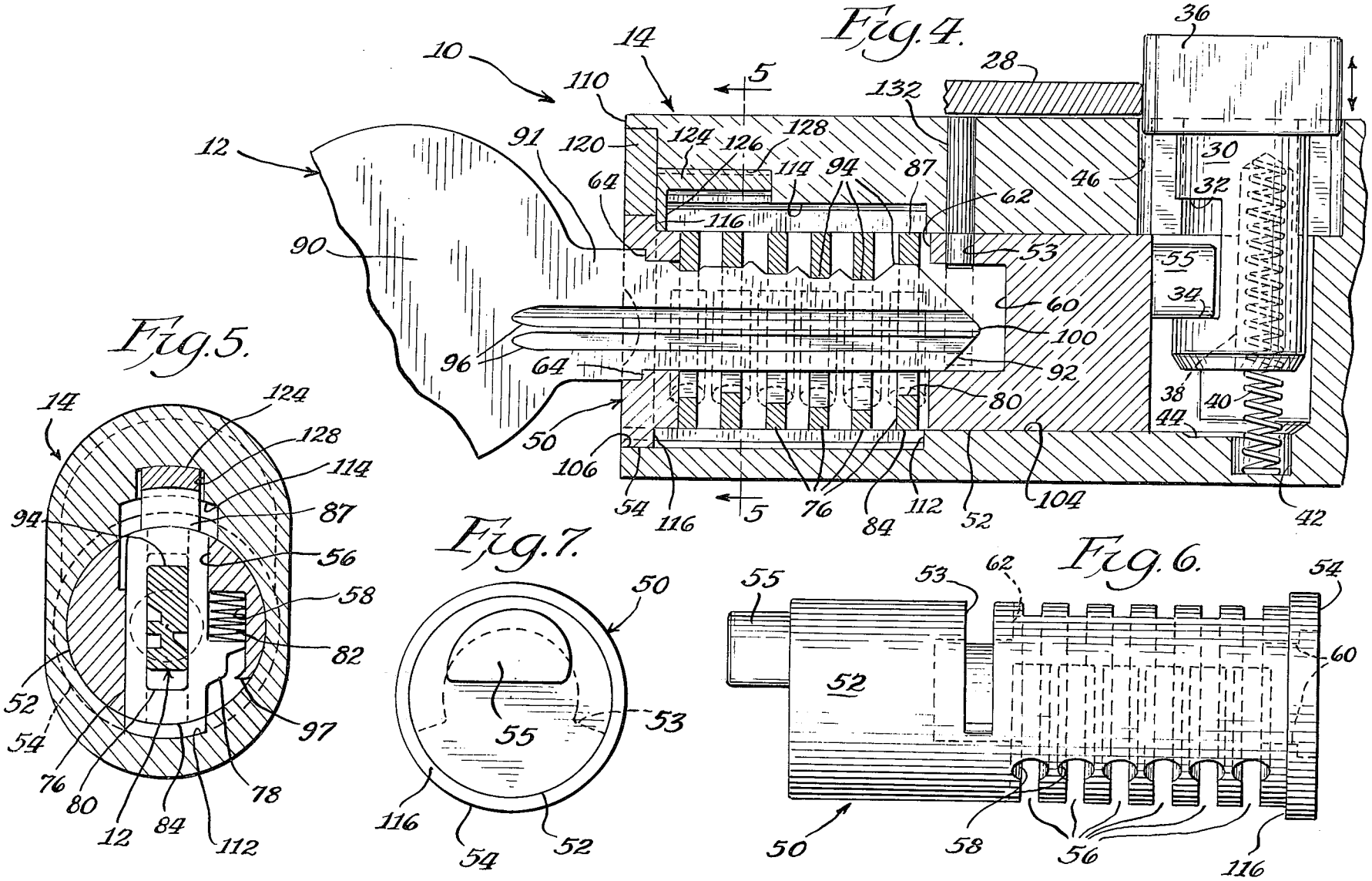
FIG. 4 is a view similar to FIG. 2, but with a key inserted in the lock, portions of the key and the lock being broken away.
FIG. 5 is a cross sectional view of the lock with key inserted, taken substantially on line 5—5 of FIG. 4.
FIG. 6 is an enlarged side elevational view of a key plug of the lock, as viewed from the side opposite to that visible in FIG. 1.
FIG. 7 is an enlarged elevational view of the rear or inner end of the key plug.

Referring to the drawings, a filing cabinet lock 10 is illustrated in FIGS. 1–5, and a single-bitted key 12 for the lock is illustrated in FIG. 4. Referring to FIG. 1, the lock 10 includes a barrel 14, a locking bolt 16 carried by the barrel, a key plug assembly 18 inserted in the barrel, and a cover assembly 20 mounted on the front end of the barrel.

The barrel 14 is dimensioned and shaped to correspond to the hitherto standard filing cabinet lock barrels. In particular, it has a generally elliptical or elongated oval cross section or contour, with generally standard dimensions of width and height. The barrel 14 may be provided in one of several generally standard lengths. The barrel is mounted in a complementary elliptical opening in the face of a filing cabinet and secured to appropriate linkage, not shown, in the cabinet. For this purpose, a linkage slot 22 is provided adjacent the rear end of the barrel 14, and the slot extends in the direction of the long transverse axis, between the opposed narrow, rounded sides 23 and 24 of the barrel. A linkage screw hole 25 extends through the rear portion of the barrel 14, to intersect the linkage slot 22 at about its center. As mounted, the rear end of the barrel 14 is subjected to spring force, tending to push the barrel 14 outwardly from the face of the filing cabinet. In use, the barrel 14 is moved between an inner position, recessed within a filing cabinet, and an outer, projecting position. In the inner position, the linkage connected to the barrel 14 is arranged for locking the cabinet, and in the outer position, the linkage releases the filing cabinet drawers, so that they may be withdrawn from the cabinet.

Conventionally, a filing cabinet lock is manipulated by a key-operated plug assembly, which cooperates with a locking bolt. Likewise, the lock 10 of the present invention is operated by means of the plug assembly 18 and the locking bolt 16. The locking bolt 16 is moved in and out of a bolt recess 26 extending from one narrow side 23 of the barrel 14, adjacent to the linkage slot 22. When the bolt 16 projects from the recess 26, in the inner position of the barrel 14, it engages a suitable stop member 28 (FIGS. 2 and 4) on the interior of a filing cabinet, to lock the cabinet. When the bolt 16 is drawn into the recess 26, the barrel 14 is released, so that it may be moved to its outer position by the spring force behind it, thereby unlocking the cabinet. The manner in which the lock operates is described in greater detail hereinafter.

Referring to FIGS. 1 and 2, the locking bolt 16 is of conventional construction, and it includes a cylindrically shaped body 30 having a transverse cam groove 32 bordered by a cam follower surface 34 on the inner side of the groove. The outer end of the body 30 is surmounted by an integral rectangular bolt lug 36. The inner end of the body 30, having a beveled edge, is provided with a bore 38, which extends longitudinally in the body. The bore 38 serves to receive a coil compression bolt spring 40.

The bolt 16 is mounted in the bolt recess 26 with the bolt spring 40 inserted in the bolt bore 38 and in a well 42 at the base of the recess 26, as illustrated in FIG. 2. The bolt 16 may be received completely within the recess 26, bottoming on a bolt seat 44 at the base of the recess. The rectangular lug 36 is received in complementary grooves 46 at the outer end of the recess 26. The lug 36 is held firmly and prevented from rotating in its projected position, illustrated in FIG. 2. The force of the bolt spring 40 tends to move the bolt 16 into its projected position. The bolt 16 is drawn into the recess by operation of the plug assembly 18, as described hereinafter. When the bolt 16 is thus withdrawn, the barrel 14 is pushed outwardly by spring force, as described above, while the bolt is confined within its recess 26 by the stop member 28 in the filing cabinet adjacent to the narrow side 23 of the barrel 14, or by other similar structure in the cabinet.

The structure thus far described in detail is, in general, conventional in a filing cabinet lock. Likewise, it is conventional to employ a rotatable key plug assembly which is inserted in a lock barrel and has a rearwardly projecting cam received in the cam groove 32 and cooperating with the follower surface 34 of the locking bolt 16, for drawing the bolt into a recess such as the bolt recess 26. However, the key plug assembly conventionally provided in a filing cabinet lock is of the split-pin tumbler type, which, as noted above, is relatively expensive.

In the present invention, it has been found possible, despite the limitations imposed by standard filing cabinet lock design, to employ a key plug assembly of the spring-pressed plate tumbler type, together with certain structural elements in the lock barrel. In this connection, such type of key plug assembly is, in general, conventional, but it has not been employed in file cabinet locks. The projection of the plate tumblers from opposite sides of the plug in such assembly has required a plug head of greater size than employed in file cabinet locks, for covering the necessary tumbler-receiving slots or openings in the lock barrel. As will appear, this difficulty is overcome in the present invention, in part by taking advantage of the ability to vary the degree of projection of the plate tumblers for locking purposes without affecting the operation of the lock, and in part by employing a cover member adjacent to the plug head.

Referring to FIGS. 1–3, 6 and 7, the plug assembly 18 includes a key plug 50 having a cylindrical body 52 and an enlarged cylindrical head 54 on the body. These plug components are constructed in generally conventional sizes for file cabinet locks. An arcuate retaining pin groove 53 is formed around the periphery of the body 52. A bolt-operating cam 55 is integral with the inner end of the body 52 and projects longitudinally therefrom.

A plurality of tumbler-receiving slots 56 is provided in the body 52, there being six slots in the illustrative embodiment, each slot being generally rectilinear and including a cylindrically shaped enlargement or bore 58 on one side thereof, as seen in FIGS. 3 and 6. A keyway 60 extends longitudinally through the plug 50, and it intersects the medial portions of the tumbler-receiving slots 56. A longitudinal slot 62 is formed in the body 52 in the manufacturing process, and the keyway 60 registers therewith in the body. A pair of shoulders 64 is provided at the entrance to the keyway 60, on opposite sides thereof. As seen in FIG. 3, three guide lugs or wards 66, 68 and 70 extend into the keyway 60.

Six plate or disc tumblers 76 are mounted in respective tumbler slots 56. The tumblers are elongated, generally rectangular members having rounded ends 84 and 87 and a shoulder 78 projecting from one edge thereof. Each tumbler 76 is provided with a generally rectangular key-receiving opening 80, with the disposition of the opening relative to the ends 84 and 87 of the tumbler varying from tumbler to tumbler, according to the code selected for a particular lock. The tumblers are transversely slidable in the slots 56, while their openings 80 are in partial registry with the keyway 60. A coil compression spring 82 is inserted in the enlargement 58 of each slot 56, and the tumbler shoulder 78 is seated thereon. As seen in FIGS. 1 to 3, the spring 82 biases each tumbler to a position wherein one end 84 projects outwardly from one side 86 of the plug assembly, and the opposite end 87 of the tumbler is recessed from the opposite side 88 of the plug assembly. The former side 86 of the assembly is referred to as the "soft side" of the assembly, having reference to the fact that the tumblers have freedom to move in or out against the bias of the springs 82. The opposite side 88 of the assembly is referred to as the "hard side".

The tumbler 76 are moved in their slots 56 by insertion of the key 12, illustrated in FIG. 4. The illustrative key 12 includes a flat key bow 90, a shank 91 extending therefrom, and a bit 92 extending from the shank. One edge of the bit 92 is provided with a series of bittings 94 which engage the tumblers 76 in their openings 80. Guide grooves complementary to the guide lugs 66, 68 and 70 are provided in the shank 91 and the bit 92, two such grooves being illustrated in FIG. 4 and identified by the number 96. When the key 12 is fully inserted with its shank 91 seated on the shoulders 64 at the entrance to the keyway 60, the tumblers 76 are disposed within the confines of the plug body 52.

Considering the operation of the plug assembly 18 when it is not mounted in the barrel 14, in the absence of a key (as illustrated in FIG. 1), the tumblers 76 extend from the "soft side" 86 of the assembly under the bias of the springs 82, to the extent permitted by staked or crimped rim portions 97 of the bores 58 (see FIGS. 3 and 5). For example, ends 84 of the tumblers 76 may project from the body 52 to the extent of about 1/16 inch. When the key 12 is inserted in the keyway 60, the nose 100 of the key bit 92 enters the openings 80 in the successive tumblers 76, and cams them onto the first bitting 94. The tumblers then move transversely back and forth as they encounter successive valleys and ridges forming the bittings 94, until the key is fully inserted and the tumblers are seated on the bittings 94 in their final positions, illustrated in FIG. 4.

During insertion of the key, the ends 87 of the tumblers may move outwardly in the direction of the hard side 88 of the plug assembly 18 for as much as 1/16 inch. Thus, about 1/16 inch of clearance or space would need to be provided on the opposite sides of the plug assembly 18, to accommodate the normal maximum extent of projection of the tumbler ends 84 and 87. However, the tumbler ends 84 at the soft side being resiliently supported on the springs 82 (giving rise to the term soft side), may be confined to lesser distances of projection. On the other hand, the opposite tumbler ends 87 are supported on the key bit 92 as the tumblers are moved, with no opportunity to move inwardly from that end (giving rise to the term hard side), so that space must be provided to accommodate the full extent of projection of such tumbler ends during insertion of the key 12.

The barrel 14 is provided with a cylindrical plugreceiving bore 104 extending longitudinally from the front end of the barrel adjacent to one narrow, rounded side 24, such side being continuous to the linkage slot 22 and opposite to the side 23 from which the bolt recess 26 extends. A counterbore 106 is provided around the bore 104, and a recess 108 is provided adjacent to the counterbore, with their bottoms in the same plane. The counterbore 106 and the recess 108 are bounded by a rim 110. The bore 104 closely receives the plug body 52, and the counterbore 106 closely receives the plug head 54. First and second longitudinal tumbler-receiving slots 112 and 114 are provided in the barrel 14 on opposite sides of the bore 104 therealong, the first slot 112 being adjacent to the continuous narrow, rounded side 24 of the barrel.

The slots 112 and 114 are arranged, and their widths are sufficient, to receive the respective ends 84 and 87 of the tumblers 76 therein. The depth, or radial extent, of the first slot 112 is not greater than the width or radial extent of the flange 116 (see FIG. 2) of the plug head 54, and in the illustrative embodiment, is substantially equal thereto. Consequently, the plug head 54 covers the outer end of the first slot 112 and prevents access thereto from outside of the barrel 14. The soft ends 84 of the tumblers 76 extend into the first slot 112 and bear against the outer wall of the barrel 14. The tumblers 76 are confined in this manner, against the pressure of the springs 82, although they could extend further outwardly if permitted to, as will be seen upon reference to FIG. 3. However, by restricting the extent of the tumbler projection, the depth of the first slot 112 may be limited to such as may be covered and protected from access by the plug head 54, particularly, by its flange 116.

The second tumbler-receiving slot 114, diametrically opposed to the first slot 112, receives the "hard" tumbler ends 87, and the second slot has a depth or radial extent sufficient to accommodate the greatest possible projection of the ends 87 as they are cammed outwardly by the ridge portions of the key bit 92. As illustrated in FIGS. 2 and 4, the radial extent of the second slot 114 from the axis of the bore 104 is greater than that of the flange 116 on the plug head 54. Consequently, the flange 116 covers but a portion of the outer end of the second slot 114.

The cover assembly 20 includes a cover member or face plate 120, of generally crescent shape, which is provided for covering the remaining portion of the outer end of the second slot 114, thereby preventing access to the second slot from outside of the barrel 14. The cover member 120 is received in the recess 108 in the front end of the barrel 14 and is closely bordered by the rim 110.

A mounting bracket 122 is fixed to the inner surface of the cover member 120, and it includes a mounting arm 124 and a catch 126 at a right angle to the arm. A cover mounting slot 128 is provided in the barrel 14, and it extends from the front end of the barrel along the second tumbler-receiving slot 114. The mounting slot 128 receives the mounting arm 124 therein, for engagement of the bracket 122 with the barrel 14 to hold the cover member 120 in place. The catch 126 extends transversely behind the flange 116 of the plug head 54, as illustrated in FIGS. 2 and 4, for retention of the cover member 120 by the plug head 54.

A pin hole 130 extends into the barrel 14 from one narrow side 23 thereof. The hole 130 is located so as to align with the retaining pin groove 53 in the plug body 52 when the plug 50 is fully inserted in the bore 104 of the barrel 14. A knurled retaining pin 132 is inserted into the pin hole 130, in a press fit with the barrel, and extends into the pin groove 53. In this manner, the plug assembly 18 is permanently assembled in the barrel 14, and the assembly may be rotated to the extent permitted by the pin groove 53.

An advantage of the new construction is that the barrel 14 and the plug 50 may be die cast of suitable metal, provision being made for forming the various slots and openings while permitting withdrawal of the core pieces employed in casting. The economies effected in the manufacture of the several parts and the economy of assembly time and labor result in a minimum cost for the lock 10.

In use, with the lock 10 installed in a file cabinet, the lock is in the condition illustrated in FIGS. 2 and 3 when the cabinet is locked. The soft ends 84 of the tumblers 76 are spring-pressed into the slot 112 in the barrel 14. The tumbler ends 84 engage the barrel at the sides of the slot 112, to prevent rotation of the plug 50. The locking bolt 16 is in its locking position projecting from the barrel side 23, urged outwardly by its spring 40. The lug 36 of the bolt 16 engages the stop member 28 of the file cabinet, to retain the lock 10 within the cabinet in a position serving to lock the cabinet drawers through the linkage conventionally employed for the purpose.

To unlock the file cabinet, the key 12 is inserted into the plug 50, as illustrated in FIGS. 4 and 5. The tumblers 76 are moved into engagement with the key bittings 94, to positions substantially within the confines of the plug body 52, not projecting therefrom in a manner such as would interfere with rotation of the body 52 in the plug bore 104. The plug 50 then may be rotated, in either direction, by turning the key 12. As the plug rotates, its cam 55 engages the follower surface 34 on the locking bolt 16, and moves the bolt inwardly, from its locking position projecting from the barrel side 23 to an unlocking position substantially within the confines of the barrel 14, the bolt being withrawn against the pressure of its spring 40. The lock 10 then is projected out of the filing cabinet to a certain extent, by the force of conventional spring means acting on its rear end, at the linkage slot 22. The stop member 28 prevents the bolt lug 36 from leaving its recess 26.

The key 12 may be withdrawn from the lock, while the cabinet remains unlocked. In order to withdraw the key, it is necessary to turn it to its original position, inasmuch as in its rotated positions, it will be held in the plug 50 by the tumblers 76, which are held in their positions illustrated in FIG. 4 by the wall of the plug bore 104. By withdrawing the key, the plug assembly 18 is returned to the condition illustrated in FIG. 2, wherein the plug 50 is prevented from rotating relative to the barrel 14 owing to the interconnection resulting from projection of the tumbler ends 84 into the first slot 112. It is then necessary only to push the lock 10 back into the filing cabinet in order to lock the cabinet, the locking bolt 16 being moved outwardly by its spring 40 when its lug 36 clears the stop member 28 holding it in the recess 26.

While a preferred embodiment of the invention has been illustrated and described, it will be apparent that various changes and modifications may be made therein within the spirit and scope of the invention. It is intended that such changes and modifications be included within the scope of the appended claims.

Having thus described the invention, what I claim as new and desire to secure by Letters Patent is:

1. In a filing cabinet lock including a barrel having a generally elliptical cross section and a cylindrical plug-receiving bore extending longitudinally from one end of the barrel adjacent to one of its narrow, rounded sides, the improved combination with:

a key plug rotatably received in said barrel and including a cylindrical body received in said plug-receiving bore and an enlarged cylindrical head on the body, said plug body having transverse tumbler-receiving slot means and a longitudinal keyway intersecting said slot means, a plurality of plate tumblers and tumbler springs mounted in said slot means for cooperation with a single-bitted key inserted in said keyway, said tumblers projecting from one side of said plug body yieldably under the bias of said springs for locking interengagement with said barrel, and upon insertion of a key said tumblers being moved slidably in said slot means against said spring bias from their first-described projecting positions through positions projecting from the opposite side of said plug body as the key is inserted and ultimately to positions substantially within the confines of the plug body and disengaged from the barrel, thereby releasing the plug body for rotation by the key for unlocking purposes, means forming first and second slots in said barrel and extending from said barrel end along said plug-receiving bore, said first slot being adjacent to said one narrow side of the barrel and said second slot being opposite thereto, said first and second slots receiving the projecting ends of said tumblers in their respective first and second-described projecting positions, said plug head covering the outer end of said first slot and a portion of the outer end of said second slot, and a cover member mounted on said barrel and covering the remainig portion of the outer end of said second slot, whereby access to said slots from outside of the barrel is prevented.

2. A lock as defined in claim 1 and wherein said barrel is provided with a cover mounting slot extending longitudinally from said barrel end, and including a mounting arm extending inwardly from said cover member into said cover mounting slot.

3. A lock as defined in claim 2 and including a catch extending transversely from said cover member and behind said plug head for retention of the cover member thereby.

4. In a filing cabinet lock including a barrel having a generally elliptical cross section, a cylindrical plug-receiving bore extending longitudinally from one end of the barrel adjacent to one of its narrow, rounded sides, and a counterbore around said bore for receiving an enlarged plug head, the improved combination with:

a key plug rotatably received in said barrel and including a cylindrical body received in said plug-receiving bore and an enlarged cylindrical head on the body received in said counterbore, said plug body having transverse tumbler-receiving slot means and a longitudinal keyway intersecting said slot means, a plurality of plate tumblers and tumbler springs mounted in said slot means for cooperation with a single-bitted key inserted in said keyway, said tumblers projecting from one side of said plug body yieldably under the bias of said springs for locking interengagement with said barrel, and upon insertion of a key said tumblers being moved slidably in said slot means against said spring bias from their first-described projecting positions through positions projecting form the opposite side of said plug body as the key is inserted and ultimately to positions substantially within the confines of the plug body and disengaged from the barrel, thereby releasing the plug body for rotation by the key for unlocking purposes, means forming a recess in said barrel end and adjoining said counterbore, means forming first and second slots in said barrel and extending from said barrel end along said plug-receiving bore, said first slot being adjacent to said one narrow side of the barrel and said second slot being opposite thereto, said first and second slots receiving the projecting ends of said tumblers in their respective first and second-described projecting positions, said plug head covering the outer end of said first slot and a portion of the outer end of said second slot, and a cover member received in said recess and covering the remaining portion of the outer end of said second slot, whereby access to said slots from outside of the barrel is prevented.

5. A lock as defined in claim 4 and wherein said barrel is provided with a cover mounting slot extending from said barrel end along said second slot, and including a mounting arm extending inwardly from said cover member into said cover mounting slot.

6. A lock as defined in claim 4 and wherein said barrel is provided with a cover mounting slot extending from said barrel end along said second slot, and including a mounting bracket on said cover member, said bracket including a mounting arm extending inwardly from said cover member into said cover mounting slot, and a catch extending transversely behind said plug head for retention of the cover member thereby.

7. A lock as defined in claim 4 and wherein said barrel is provided with a bolt recess extending transversely from the remaining one of its narrow, rounded sides, and including a locking bolt slidably movable in said bolt recess from a locking position projecting from said remaining barrel side to an unlocking position substantially within the confines of the barrel, and meams interengaging said bolt and said plug body for moving said bolt from said locking position to said unlocking position upon rotation of the plug body.

* * * * *